United States Patent [19]

Mowli

[11] Patent Number: 4,792,294

[45] Date of Patent: Dec. 20, 1988

[54] TWO-STAGE SCREW AUGER PUMPING APPARATUS

[76] Inventor: John C. Mowli, 640 Sanders Ct., Gurnee, Ill. 60031

[21] Appl. No.: 850,801

[22] Filed: Apr. 11, 1986

[51] Int. Cl.[4] ..... F04C 2/16

[52] U.S. Cl. ..... 418/9; 418/201; 425/208; 425/376.1; 366/85

[58] Field of Search ..... 418/9, 201, 206; 425/376 R, 376 A, 208; 366/85, 301

[56] References Cited

U.S. PATENT DOCUMENTS

| | | | |
|---|---|---|---|
| Re. 18,527 | 7/1932 | Simmons | 418/9 |
| 1,164,546 | 12/1915 | Neuland | 418/9 |
| 2,358,815 | 9/1944 | Lysholm | 418/9 |
| 2,543,894 | 3/1951 | Colombo | 425/376 R |
| 2,592,476 | 4/1952 | Sennet | 417/201 |
| 2,975,963 | 3/1961 | Nilsson | 418/9 |
| 2,994,562 | 8/1961 | Zalis | 418/201 |
| 3,279,682 | 10/1966 | Vagenius | 418/9 |
| 3,467,300 | 9/1969 | Schibbye | 418/9 |
| 3,481,532 | 12/1969 | Fraser | 418/9 |
| 3,734,635 | 5/1973 | Blach | 425/376 R |
| 3,807,911 | 4/1974 | Caffrey | 418/9 |
| 4,017,241 | 4/1977 | Papinchak | 425/208 |
| 4,529,363 | 7/1985 | Suzuki | 418/201 |

FOREIGN PATENT DOCUMENTS 967196 10/1950 France ..... 418/201

OTHER PUBLICATIONS

Product brochure, *Doering Pump Feeders;* pp. 1–4, Jun., 1981.

*Primary Examiner*—Leonard E. Smith
*Assistant Examiner*—Leonard P. Walnoha
*Attorney, Agent, or Firm*—Dressler, Goldsmith, Shore, Sutker & Milnamow

[57] ABSTRACT

A two-stage pumping apparatus is disclosed which is particularly suited for moving highly viscous materials, and other materials which do not readily lend themselves to pumping. The apparatus includes a generally vertically oriented housing with an infeed opening defined generally at the upper end thereof for gravity infeed of material into the apparatus. A pair of cooperating, counter-rotating screw augers are provided within the housing for rotation together about respective parallel axes. By this arrangement, material moves axially of the augers generally downwardly through the pump housing to a discharge opening defined by the housing. Notably, each of the screw augers includes helical flights intermeshed with the flights of the other auger, with the flights configured to provide a two-stage pumping action, including a first, upstream non-positive displacement pumping, and a second, downstream positive displacement pumping.

8 Claims, 2 Drawing Sheets

10
16
20
20
14
12
36
36
38
38
3
3
40
40
42
42
17
18
32
32
30
26
28
24
22
18
12
16
10

TWO-STAGE SCREW AUGER PUMPING APPARATUS

TECHNICAL FIELD

The present invention relates generally to a pumping apparatus including a pair of cooperating screw augers, and more particularly to a two-stage pumping apparatus particularly suited for pumping highly viscous liquids, semi-solids and like materials which otherwise are not readily pumped.

BACKGROUND OF THE INVENTION

Commercial preparation of many different food and non-food products requires use of pumping equipment suited for pumping materials which do not readily flow or are otherwise difficult to pump. For example, food products such as cheeses, lards and shortenings, ground meat, sugars, and doughs, typically require the use of specialized multi-stage pumping devices for effecting desired movement of such materials. Similarly, non-food products such as adhesives, soaps, putties and caulking compounds, and the like require the use of specialized pumping equipment if efficient handling is to be achieved.

A typical construction for a multi-stage pumping apparatus for use with such materials comprises a pair of generally horizontally arranged, cooperating screw augers. In such an arrangement, each auger is typically provided with a helical, so-called Archimedian flight, with rotation of the augers together acting to advance material axially of the augers by non-positive displacement pumping. The screw augers are typically arranged to move material through an inwardly tapered transition element having a generally oval-shaped inlet which receives material from both of the augers. Typically, a positive-displacement pump is provided immediately downstream of the transition element, with the positive-displacement pump including cooperating, multi-lobular rotors which positively pump the material to associated downstream equipment.

Infeed of material into this type of pump construction is typically effected via an infeed opening which opens downwardly to the side-by-side screw augers. Since these types of pumps are frequently used with material which does not flow readily, a paddle-like, so-called power feed roller may be operatively positioned at the infeed opening. Such a power feed roller ordinarily is rotatable about an axis spaced above and transverse to the parallel axes of the screw augers, with the feed roller including paddle-like vanes which engage the material in the infeed opening and act to drive it downwardly toward the screw augers.

While the above-described pump construction has been widely used, the shortcomings in its design will be readily appreciated. In view of the various driven screw augers, positive displacement rotors, and power feed roller, such an apparatus typically requires multiple drive motors, as well as suitable drive trains for powering the various movable components. This, of course, further adds to the already considerable expense associated with the relatively large number of components which are required. Further, the infeed of this type of apparatus can be subject to problem of "tunneling" or "bridging". These terms refer to a "carving out" action by the screw augers and/or the power feed roller on a mass of material at the infeed, whereby material movement is substantially interrputed.

In view of the widespread need for a pumping apparatus which can move materials which are otherwise very difficult to pump, it is desirable to provide a pumping apparatus particularly suited for efficiently handling such materials. Preferably, such an apparatus should not only lend itself to reliable and uninterrupted operation, but further is preferably configured for economical manufacture and convenient, versatile use.

SUMMARY OF THE INVENTION

In accordance with the present invention, a two-stage pumping apparatus is disclosed which is particularly suited for handling highly viscous liquid and semi-liquid materials, substantially solid materials, and particulates. Generally, the present apparatus comprises a desirably straightforward construction which includes a pair of cooperating screw augers positioned generally vertically within an associated housing. Notably, the arrangement is such that gravity infeed of material in a direction axially of the augers is provided, with rotatable driving of the augers desirably effected generally at their downstream ends. Further, helical flights of the augers are configured such that a two-stage pumping action is provided, including a first, upstream non-positive displacement pumping, and a second, downstream positive displacement pumping.

The pumping apparatus embodying the principles of the presett invention comprises a pump housing which defines a material infeed opening, and at least one material discharge opening. The apparatus further includes a pair of screw augers which extend within the pump housing, with the augers being rotatable together, preferably in counter-rotation, about respective parallel axes.

Each of the augers includes helical flights which are intermeshed with the flights of the other auger. By this arrangement, counter-rotation or other cooperation of the augers acts to move material through the pump housing generally axially of the augers from the material infeed opening downstream to the material discharge opening.

In the preferred embodiment, the pump housing is configured so as to define the material infeed opening in an orientation for gravity infeed of material into the apparatus. Further, the housing preferably defines the infeed opening in an orientation relative to the screw augers such that the gravity infeed of material is in a direction generally axially of the augers. This arrangement has been found to desirably promote feeding of material to the augers, without the need for ancillary driven power feed rollers or the like.

Significantly, the helical flights of each screw auger comprise a first, upstream, non-positive displacement flight, and a second, downstream positive displacement flight. The upstream flight preferably comprises a relatively simple Archimedian screw, while the downstream, positive displacement helical flight is configured for close conformance with the other auger.

By this arrangement, a two-stage pumping action is provided by the single pair of screw augers. The upstream flights of the auger provide a non-positive displacement pumping action which acts to continuously feed the positive displacing, downstream flights. A net positive head is thereby continuously created by the upstream flights for assuring material movement into the downstream flights while avoiding cavitation.

The positive displacing nature of the downstream flights provides the necessary pressures for moving the material to ancillary equipment without resort to additional positive displacement pumps or the like. Further, the manner in which the screw augers are arranged within the associated housing, with driving of the screw augers generally at their downstream ends, facilitates efficient sealing of the apparatus since dynamic seals for the auger drives can be provided in a positive pressure region of the pump.

Other features and advantages of the present invention will become readily apparent from the following detailed description, the accompanying drawings, and the appended claims.

DETAILED DESCRIPTION

Figures 1, 2:
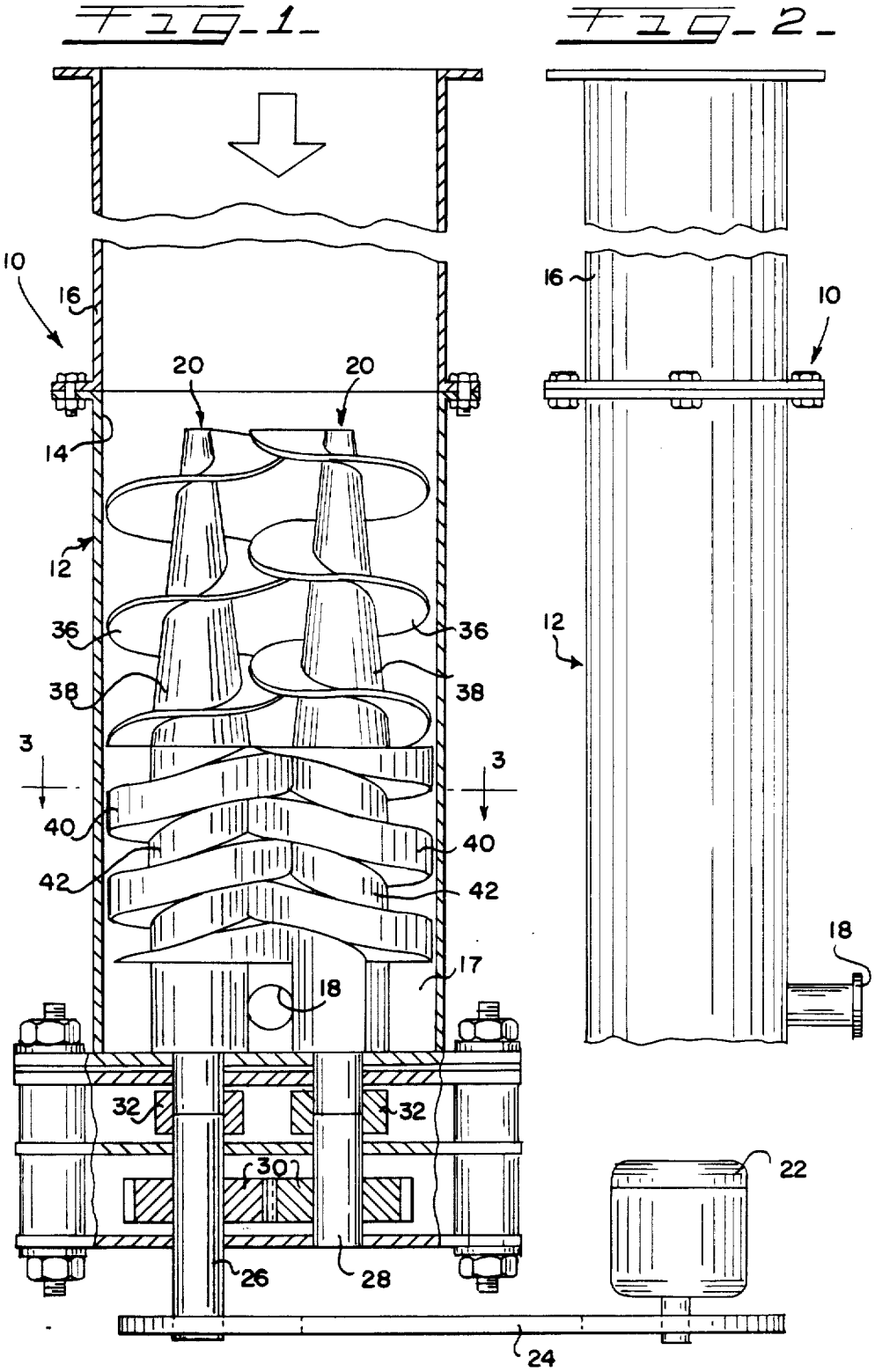
FIG. 1 is a diagrammatic, elevational view, partially in cross-section, illustrating a two-stage pumping apparatus embodying the principles of the present invention.
FIG. 2 is a partial, side-elevational view of the pumping apparatus shown in FIG. 1.

While the present invention is susceptible of embodiment in various forms, there is shown in the drawings and will hereinafter be described presently preferred embodiments of the invention, with the understanding that the present disclosure is to be considered as an exemplification of the invention, and is not intended to limit the invention to the specific embodiments illustrated.

Figures 3, 4:
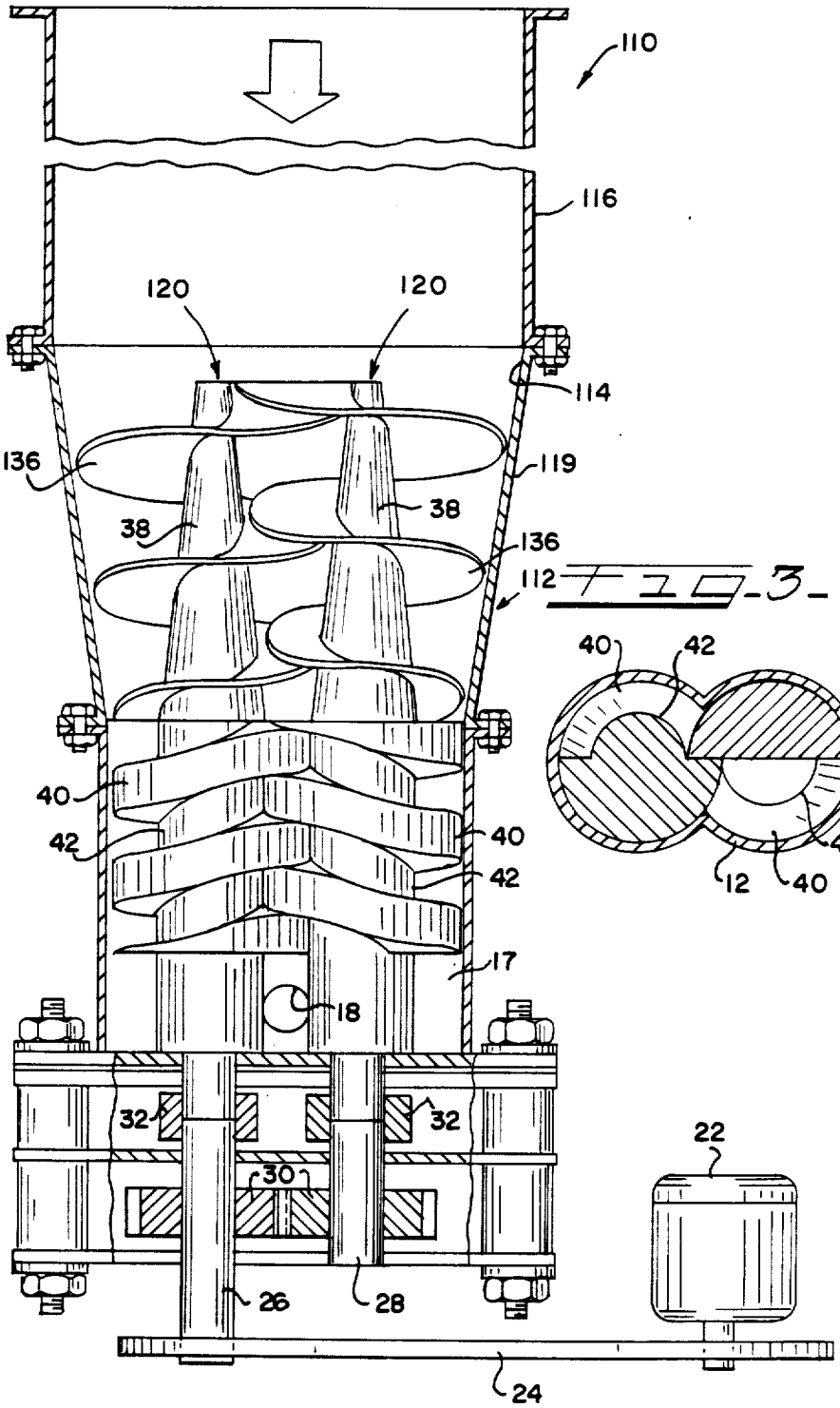
FIG. 3 is a cross-sectional view taken along lines 3—3 of FIG. 1.
FIG. 4 is a diagrammatic view similar to FIG. 1 illustrating a modified embodiment of the present pumping apparatus.

Referring first to FIGS. 1, 2, and 3, therein is illustrated a two-stage pumping apparatus 10 embodying the principles of the present invention. Notably, pumping apparatus 10 is arranged for gravity infeed of material to be pumped, thus desirably promoting feeding of materials that otherwise may tend to resist movement into and through the pumping apparatus.

To this end, apparatus 10 includes a generally vertically oriented pump housing 12 which is preferably of a generally oval-shaped or "figure-eight" cross-section (see FIG. 3). Housing 12 defines a material infeed opening 14 generally at its upper end through which material is introduced into the apparatus. If desired, the housing can be provided with an associated infeed hopper 16 extending generally upwardly from the infeed opening for holding material being introduced by gravity into the pumping apparatus.

Movement of material through the pumping apparatus 10 is generally downwardly through pump housing 12 into a pressurized discharge cavity 17. Material is moved out of the apparatus via at least one discharge opening 18 defined by the pump housing 12 in communication with the discharge cavity. While a single, generally centrally disposed discharge opening 18 is illustrated, it will be appreciated that a pump in accordance with the present teachings may instead include two or more spaced apart discharge openings positioned generally in the lower region of the pump housing in communication with the discharge cavity 17. Since material in the discharge cavity is continuously pressurized attendant to pump operation, two or more "streams" of material can readily be formed (by the provision of a corresponding number of discharge openings) without resort to additional flow dividers or the like. Thus, a single pumping apparatus 10 can readily be employed to supply material to more than one associated processing stream.

Movement of material generally downward through pump housing 12 is effected by a pair of intermeshed, cooperating screw augers or impellers 20. Screw augers 20 are preferably generally mirror images of each other and are arranged for cooperating, counter-rotation within pump housing 12 about respective parallel axes. The interior of housing 12 is preferably formed to closely conform to the peripheral configuration of the intermeshed augers to promote efficient material movement (see FIG. 3).

Significantly, the illustrated embodiment of the present pumping apparatus is arranged such that drive of the screw augers 20 is effected generally at the downstream ends of the augers. Drive of the augers may be effected by means of a suitable drive motor 22, which can be operatively connected with the augers such as by a drive belt or chain 24 extending to a driven stub shaft 26. An additional stub shaft 28 can be employed, with meshed, interconnecting gears 30 respectively affixed to the stub shafts 26 and 28 whereby opposite, concurrent rotation is effected.

Each of the stub shafts 26 and 28 is operatively connected with a respective one of the screw augers 20 such as by means of a suitable drive coupling 32. Suitable bearings and seals, not shown, are ordinarily employed for rotatably supporting the various components, and for sealing the interior of the pump housing 12 against leakage.

In this latter regard, it should be noted that the manner in which the auger drive is operatively connected with the augers 20 generally at their downstream ends promotes reliable and versatile use of the present pumping apparatus. As will be recognized by those familiar with the art, it is sometimes necessary to employ a pumping apparatus in a processing stream in which a vacuum is established and maintained generally at the upstream, infeed portion of the pumping apparatus. For example, such an arrangement is sometimes necessary in the processing of certain cheeses.

In a pumping apparatus wherein drive of its screw augers is effected generally at their upstream ends, it will be appreciated that dynamic drive shaft seals are required which effectively seal the vacuum established generally at the infeed of the pump. However, the construction and nature of dynamic seals is such that it is typically more difficult to dynamically seal a shaft against a vacuum, as opposed to dynamically sealing the shaft against positive pressure. Thus, the illustrated arrangement of the present pumping apparatus wherein drive of the screw augers 20 is effected at their downstream ends very desirably permits the use of positive pressure dynamic seals at the drive shafts, since the region within the pump housing 12 whereat discharge cavity 17 is defined is subjected to positive pressure attendant to pump operation.

As noted above, the present pumping apparatus has been particularly configured to provide a two-stage pumping action attendant to cooperating rotation of screw augers 20. To this end, each screw auger 20 includes helical flights intermeshed with the flights of the other auger, with right-hand and left-hand helices respectively provided.

Notably, the helical flights of each auger include a first-stage flight 36 which extends outwardly from a respective first-stage auger core 38, and a second-stage flight 40 extending generally outwardly from a second-stage auger core 42. As will be recognized, each first-stage flight 36 is preferably configured as a so-called Archimedian screw, with the flights 36 configured relative to each other and with respect to the associated auger cores to provide a non-positive pumping action. In other words, the configuration of the flights acts to urge material downwardly within pump housing 12, but does not provide a positive pumping displacement such as in the nature of pumps having cooperating multi-lobular rotors or the like.

In the preferred form, each of the augers 20 is provided with a core from which its respective flights extend, wherein the core includes at least a portion which is generally tapered and increasing in dimension in a direction corresponding to the direction of movement of material through the pumping apparatus (i.e., generally downwardly). In the most preferred form, each first-stage core 38 is generally tapered as illustrated, so that the "point" of each tapered core is disposed generally at the free ends of the augers 20 where material infeed is effected, with each first-stage flight 36 extending from the tapered core.

This arrangement has desirably been found to promote "piercing" of material which is being fed by gravity into the pumping apparatus. Thus, problems of "tunneling" and "bridging", such as have been common with previous constructions are desirably abated without resort to additional driven feed rollers o the like. Further, this arrangement functions in the nature of in auger having a decreasing pitch to desirably provide progressively increasing pressures in the direction of material movement within the housing.

While the first-stage flight portions 36 provide a non-positive displacement action, the lower, downstream second-stage flight portions 40 of each auger have been specifically configured to provide a positive displacement pumping. As will be observed, each flight 40 is configured to closely conform and mesh with the flight 40 and core 42 of the other auger, whereby a positive displacement pumping action is provided, much in the nature of a positive displacement pump having lobular rotors. Close conformance of the pump housing 12 to the peripheries of flight portions 40 promotes this positive displacement action.

Thus, the present arrangement desirably provides two pumping stages in immediate succession while still employing but a single pair of screw augers which can be driven together by but a single drive. In view of the positive displacing nature of the second-stage flights 40, it is preferred that these flights terminate in spaced relation to the end of the interior of pump housing 12 to thus define discharge cavity 17. This arrangement helps to prevent any inadvertent jamming of the augers, which might otherwise occur in view of the positive displacing nature of second-stage flights 40.

By providing the first and second pumping stages in immediate succession, a pressure drop at the transition is desirably avoided. A pressure drop at the interface of the first and second pumping stages is further avoided by configuring second-stage cores 42 to be of the same diameter as the lower ends of first-stage cores 38. Streamlined flow is thus promoted.

Further, the non-positive first stage desirably acts to create a net positive suction head at the second stage, thereby avoiding second-stage cavitation. To further avoid cavitation or "starving" in the second stage, the first-stage flights 36 are preferably configured to provide a slight "overfeeding" (i.e., supply an excess of material) to the second-stage flights 40. Since this configuration results in shearing and heating of the associated material being pumped, the degree of overfeeding which flights 36 are configured to provide is preferably selected in accordance with the specific application of the pumping apparatus.

Referring now to FIG. 4, therein is illustrated an alternate embodiment of the present pumping apparatus, designated 110. In many respects, this alternate embodiment is configured like the previously-described embodiment, and thus like elements are identified by like reference numerals. Elements which are somewhat different than those previously described, but which generally correspond in function, are designated by like reference numerals in the one-hundred series.

In this modified embodiment, a modified pump housing 112 is provided, wherein the pump housing defines a material infeed opening 114, and is illustrated as being provided with an infeed hopper 116. Notably, housing 112 includes a tapered housing portion 119 which is inwardly tapered in a direction corresponding to the direction of material movement through the pumping apparatus (i.e., housing portion 119 is downwardly, inwardly tapered). This modified embodiment of the present pump further includes cooperating screw augers 120 wherein the first-stage flights 136 of the augers are generally complemental to the inwardly tapered housing portion 119. Thus the intermeshing flights 136 decrease in dimension in the direction of material movement through the pump housing.

This modified embodiment further promotes infeed of material into the pumping apparatus. The relatively "oversized" feed hopper 116 can be dimensioned for receiving large blocks of material, such as cubes of butter or the like, without resort to "pre-cutting" of the relatively large blocks as is now commonly required The complemental configuration of the flights 136 with respect to the tapered housing portion 119 assures the smooth flow of material through the apparatus, with the preferred, generally tapered auger core portions again facilitating material infeed.

From the foregoing, it will be observed that numerous modifications and variations can be effected without departing from the true spirit and scope of the novel concept of the present invention. It is to be understood that no limitation with respect to the specific embodiments disclosed herein is intended or should be inferred. The disclosure is intended to cover by the appended claims all such modifications as fall within the scope of the claims.

What is claimed is:

1. A two-stage pumping apparatus, comprising:

a pump housing defining a material infeed opening in an orientation for gravity infeed of material into said pumping apparatus, and at least one material discharge opening;

a pair of auger means extending within said pump housing, said auger means being rotatable together about respective parallel axis for moving material through said housing generally axially of said auger means from said material infeed opening downstream to said material discharge opening, each of said auger means having a free, upstream end, said pump housing defining said material infeed opening in an orientation relative to said auger means whereby said gravity infeed of material is in a direction generally axially of said pair of auger means, said infeed opening being aligned with the parallel axes of said auger means so that material moving through said infeed opening moves substantially along said parallel axes, each said auger means comprising first stage and second-stage helical flight means respectively intermeshed with the first-stage and second-stage flight means of the other one of said auger means, whereby rotation of said pair of auger means moves material axially thereof, said flight means of each auger means being configured to provide a two-stage pumping action within said housing, including a first, upstream non-positive displacement pumping provided by said intermeshed first stage flight means, and a second, downstream, downstream positive displacement pumping provided by said second stage flight means, said first-stage flight means acting to create a net positive suction head at an interface of said first and second stage flight means, and means for rotatably driving said pair of auger means independently of said intermeshed flight means, including drive coupling means operatively connected with said auger means generally at the downstream ends thereof.

2. A two-stage pumping apparatus in accordance with claim 1, wherein said driving means rotatably drives said pair of auger means in counter-rotating relation to each other.

3. At two-stage pumping apparatus in accordance with claim 1, wherein said pump housing includes a generally tapered portion having a cross-section of decreasing dimension in a direction corresponding to the direction of movement of material through said pump housing, said intermeshing flight means of said auger means being of decreasing dimension in the direction of material movement so that said flight means are complemental to said generally tapered portion of said housing.

4. A two-stage pumping apparatus in accordance with claim 1, wherein each said auger means comprises a core outwardly from which the respective flight means extends, each said auger core including at least a portion which is generally tapered and increasing in diameter in a direction corresponding to the direction of movement of material through said pump housing.

5. A pumping apparatus, comprising:

a pump housing defining a material infeed opening, and at least one material discharge opening;

a pair of auger means extending within said pump housing, each said auger means including helical flight means intermeshed with the flight means of the other auger means, said pair of auger means being rotatable together about respective parallel axes for moving material through said housing generally axially of said auger means from said material infeed opening downstream to said material discharge opening, each of said auger means having a free, upstream end, each said auger means comprising a core outwardly from which the respective flight means extends, each said auger core including at least a portion which is generally tapered and increasing in diameter in a direction corresponding to the direction movement of material through aid pump housing, each said flight means including first-stage flight means intermeshed with the first-stage flight means of the other auger means, and second-stage flight means intermeshed with the second-stage flight means of the other auger means, said pump housing being configured to define said infeed opening in an orientation for gravity infeed of material into the pumping apparatus in a direction generally axially of said pair of auger means, said infeed opening being aligned with the parallel axes of said pair of auger means so that material moving through said infeed opening moves substantially along said parallel axes, said infeed opening being dimensioned substantially at least large as the upstream end projection of said pair of auger means, and means for rotatably driving said pair of auger means operatively connected with said auger means generally at the downstream ends thereof for driving said auger means independently of said intermeshed flight means, whereby said pair of auger means provides a two-stage pumping action within said housing, including a first, upstream non-positive displacement pumping provided by said intermeshed first-stage flight means, and a second, downstream positive displacement pumping provided by said intermeshed second-stage flight means, said first stage flight means acting to create a net positive suction at an interface of said first and second stage flight means.

6. A pumping apparatus in accordance with claim 5, wherein said pump housing includes a generally tapered portion having a cross-section of decreasing dimension in a direction corresponding to the direction of movement of material through said pump housing, said intermeshing flight means of said auger means being of decreasing dimension in the direction of material movement so that said flight means are complemental to said generally tapered portion of said housing.

7. A pumping apparatus in accordance with claim 5, wherein said driving means rotatably drives said pair of augers in counter-rotating relation to each other.

8. A method for flowing difficulty flowable material which comprises introducing said material into an infeed opening of a housing having infeed and discharge openings generally at ends, and thereby bringing said material into contact with free, upstream ends of a pair of counter-rotating auger means including respective, intermeshed helical flight means including a pair of intermeshed first stage flight means and a pair of intermeshed second stage flight means, wherein said pair of auger means are rotatably driven generally at downstream ends thereof independently of the respective, intermeshed flight means, and wherein said infeed opening is oriented for gravity infeed of the material into said housing in a direction generally axially of and in alignment with the rotational axes of said flight means, moving said material through a first pumping zone by the action of said first stage flight means of said helical flight means by non-positive displacement pumping, and thereafter moving said material into and through a second pumping zone by the action of said second stage flight means of said helical flight means by positive displacement pumping, including creating a net positive suction head at an interface of said pumping zones by the action of said first flight means, and moving said material through said interface in a direction substantially parallel to said rotational axes to promote streamlined flow of said material, and thereafter discharging said material through said discharge opening.

* * * * *